US010668609B2

(12) United States Patent
Tanaka et al.

(10) Patent No.: US 10,668,609 B2
(45) Date of Patent: Jun. 2, 2020

(54) HAND TOOL

(71) Applicant: MAX CO., LTD., Tokyo (JP)

(72) Inventors: Hiroshi Tanaka, Tokyo (JP); Tohru Uchiyama, Tokyo (JP); Mitsugu Takezaki, Tokyo (JP); Hiroki Yamamoto, Tokyo (JP)

(73) Assignee: MAX CO., LTD., Tokyo (JP)

( * ) Notice: Subject to any disclaimer, the term of this patent is extended or adjusted under 35 U.S.C. 154(b) by 282 days.

(21) Appl. No.: 15/461,804

(22) Filed: Mar. 17, 2017

(65) Prior Publication Data

US 2017/0282340 A1 Oct. 5, 2017

(30) Foreign Application Priority Data

Mar. 29, 2016 (JP) ..... 2016-065609

(51) Int. Cl.
*B25C 1/04* (2006.01)
*B25F 5/00* (2006.01)
*B25C 1/00* (2006.01)

(52) U.S. Cl.
CPC ..... *B25C 1/047* (2013.01); *B25C 1/001* (2013.01); *B25C 1/008* (2013.01); *B25F 5/00* (2013.01)

(58) Field of Classification Search
CPC .. B25C 1/08; B25C 1/18; B25C 1/143; B25C 1/008; B25C 1/123; B25C 1/085; B25C 1/047; B25C 1/043
USPC ..... 227/9–11, 130
See application file for complete search history.

(56) References Cited

U.S. PATENT DOCUMENTS 3,049,714 A * 8/1962 Bumiller ..... B25C 1/123 227/9
3,155,980 A * 11/1964 Mulno ..... B25C 1/123 227/8
4,260,092 A * 4/1981 Austin ..... B25C 1/043 227/8
5,191,861 A * 3/1993 Kellerman ..... B25C 1/08 123/46 SC
5,687,897 A * 11/1997 Fa ..... B25C 1/043 227/8
5,797,533 A * 8/1998 Lee ..... B25C 1/008 227/8

(Continued)

FOREIGN PATENT DOCUMENTS

DE A1-3337278 4/1985
EP A2-0987724 3/2000

(Continued)

OTHER PUBLICATIONS

Extended European Search Report dated Oct. 25, 2017 in corresponding European patent application 17000457.6 (10 pages).

*Primary Examiner* — Hemant Desai
*Assistant Examiner* — Christopher Robin Kim
(74) *Attorney, Agent, or Firm* — Rothwell, Figg, Ernst & Manbeck, P.C.

(57) ABSTRACT

A hand tool includes a trigger manually operated by an operator, a tool body configured to movably support the trigger, a biasing member configured to generate a biasing force for biasing the trigger in a direction opposite to a operation direction of the trigger, and a contacting member operated by a biasing force of the biasing member to act on the trigger or tool body. The biasing member and the contacting member are assembled integrally with the tool body or the trigger.

5 Claims, 10 Drawing Sheets

(56) References Cited

U.S. PATENT DOCUMENTS

2004/0232193 A1* 11/2004 Ricordi ..... B25C 1/08 227/130
2006/0185629 A1* 8/2006 Nishikawa ..... B25C 1/08 123/46 H
2006/0186166 A1* 8/2006 Akiba ..... B25C 1/008 227/10
2006/0213945 A1* 9/2006 Ke ..... B25C 1/043 227/8
2007/0194076 A1 8/2007 Lee
2009/0008423 A1* 1/2009 Sasaki ..... B25C 1/08 227/10
2009/0206120 A1* 8/2009 Komazaki ..... B25C 1/08 227/8
2009/0250498 A1* 10/2009 Chen ..... B25C 1/008 227/8
2009/0314818 A1* 12/2009 Segura ..... B25C 1/008 227/8
2010/0206933 A1* 8/2010 Wu ..... B25C 1/08 227/8
2010/0252608 A1* 10/2010 Lai ..... B25C 1/047 227/8
2011/0240709 A1* 10/2011 Oouchi ..... B25C 1/08 227/8
2012/0000031 A1* 1/2012 Liu ..... B25C 1/08 15/339
2012/0037682 A1* 2/2012 Ho ..... B25C 1/008 227/8
2012/0085806 A1* 4/2012 Lee ..... B25C 1/008 227/8
2012/0181319 A1* 7/2012 Iijima ..... B25B 21/023 227/8
2012/0292365 A1* 11/2012 Tille ..... B25C 1/08 227/99
2013/0081838 A1* 4/2013 Tully ..... B25F 5/02 173/168
2014/0158740 A1* 6/2014 Akutsu ..... B25C 1/044 227/130
2014/0197220 A1* 7/2014 Birk ..... B25C 1/08 227/8
2014/0367441 A1* 12/2014 Liu ..... B25C 1/008 227/8
2015/0182230 A1 7/2015 Belagali et al.
2016/0059398 A1* 3/2016 Wong ..... B25C 1/08 227/10
2017/0203424 A1* 7/2017 Vettoretti ..... B25C 1/008
2017/0274512 A1* 9/2017 Ishizawa ..... B25C 1/047
2017/0282340 A1* 10/2017 Tanaka ..... B25F 5/00
2018/0050396 A1* 2/2018 Lai ..... B23B 45/04
2018/0117748 A1* 5/2018 Ishikawa ..... B25C 1/046
2018/0215023 A1* 8/2018 Taylor ..... B25C 1/08

FOREIGN PATENT DOCUMENTS

JP H10-146775 A 6/1998
JP 2007-157402 A 6/2007
JP 2008-149404 A 7/2008
JP 2011-183523 A 9/2011
JP 2011-183528 A 9/2011

* cited by examiner

HAND TOOL

CROSS-REFERENCE TO RELATED APPLICATION

This application claims priority from Japanese Patent Application No. 2016-065609 filed on Mar. 29, 2016 the entire contents of which are incorporated herein by reference.

FIELD

The present disclosure relates to a hand tool provided with a trigger.

BACKGROUND

A hand tool such as a nail driving machine operated by an operation of a trigger includes a biasing means which cause the trigger to return to an initial position so as to prevent that the trigger is unintentionally operated by its own weight.

For example, in Japanese Unexamined Patent Application Publication No. 10-146775 (JP H10-146775 A), there is disclosed a tool in which a spring for causing a trigger to return to an initial position is built. An unintentional operation of the tool is prevented when the spring biases the trigger to the initial position, and thus safety can be improved.

However, the hand tool described in JP H10-146775 A, when the trigger is detached from a tool body for maintenance and the like, the spring comes off together, which may cause loss or damage of the spring. In addition, when the detached trigger is attached, the trigger is assembled necessarily in a state where the spring is deformed, so that assemblability is deteriorated, which is problematic.

In this regard, an object of the disclosure is to provide a hand tool which can prevent loss or damage of a spring at the time of maintenance of a trigger, and can improve an assemblability of the trigger.

The disclosure is made to solve the above-described problem, and is characterized as follows.

A first aspect of the disclosure is to provide a hand tool which includes a trigger manually operated by an operator, the hand tool including:

a tool body configured to movably support the trigger; a biasing member configured to generate a biasing force for biasing the trigger in a direction opposite to a operation direction of the trigger; and a contacting member operated by a biasing force of the biasing member to act on the trigger, wherein the biasing member and the contacting member are assembled integrally with the tool body.

The trigger may be detachable with respect to a support member configured to movably support the trigger, and the biasing member and the contacting member may be assembled with the support member.

The hand tool may further include a support member which is assembled with the trigger, the biasing member, and the contacting member, wherein the support member is detachable with respect to the tool body.

The tool body may include a movement regulating part configured to regulate a movement of the contacting member by the biasing member in a biasing direction, a space may be formed on a tip side of the contacting member as the movement regulating part regulates the movement of the contacting member, and the trigger may include a pressed part which is inserted into the space to be pressed by the contacting member.

The tool body may include an opening through which the trigger is capable of being inserted and extracted, and the space may be disposed to face outside through the opening in a state where the trigger is detached.

A second aspect of the disclosure is to provide a hand tool which includes a trigger manually operated by an operator, the hand tool including: a tool body configured to movably support the trigger; a biasing member configured to generate a biasing force for biasing the trigger in a direction opposite to a operation direction of the trigger; and a contacting member operated by a biasing force of the biasing member to act on the tool body, wherein the biasing member and the contacting member are assembled integrally with the trigger.

The hand tool may further include a support member with which the trigger is assembled, wherein the contacting member is provided in the trigger to be operated by a biasing force of the biasing member to act on the support member, and the support member is detachable with respect to the tool body.

The tool body may include a space which is formed at a tip side of a pressed part pressed by the contacting member, the trigger may include a movement regulating part configured to regulate a movement of the contacting member by the biasing member in a biasing direction, and the contacting member may be capable of being inserted into the space as the movement of the contacting member is regulated by the movement regulating part.

The tool body may include an opening through which the trigger is capable of being inserted and extracted, and the space may be disposed to face outside through the opening in a state where the trigger is detached.

As described above, since the biasing member and the contacting member are assembled integrally with the tool body, when the trigger, for the maintenance and the like, is detached from the tool body, the biasing member such as a spring is not fallen. Accordingly, it is possible to prevent loss or damage of the biasing member. In addition, the detached trigger is easily assembled. In addition, the use of the damaged biasing member or an assembly error of the biasing member can be prevented, thereby improving safety.

As described above, the trigger is detachable with respect to the support member which movably supports the trigger, and the biasing member and the contacting member are assembled with the support member. With such a configuration, the support member obtained by unifying the biasing member and the contacting member is easily attached in the tool body, which improves assemblability.

As described above includes a support member which is assembled with the trigger, the biasing member, and the contacting member, and the support member is detachable with respect to the tool body. With such a configuration, the support member obtained by unifying the trigger, the biasing member, and the contacting member as a unit can be attached in and detached from the tool body, which improves the assemblability.

As described above, when the movement regulating part regulates the movement of the contacting member, the space is formed on the tip side of the contacting member, and the trigger includes a pressed part which is inserted into the space to be pressed by the contacting member. With such a configuration, merely by inserting the pressed part into the space, the trigger can be assembled while the load of the biasing member is rarely received. Accordingly, it is possible to improve the assemblability of the trigger.

As described above, the tool body includes the opening through which the trigger can be inserted and extracted, and in a state where the trigger is detached, the space is disposed to face outside through the opening. With such a configuration, when the trigger is attached toward the space, the trigger can be assembled by being inserted linearly from the opening. Accordingly, the assemblability of the trigger is improved.

As described above, since the biasing member and the contacting member are assembled integrally with the trigger, when the trigger for the maintenance and the like is detached from the tool body, the biasing member such as a spring is not fallen. Accordingly, it is possible to prevent loss or damage of the biasing member. In addition, the detached trigger is easily assembled. In addition, the use of the damaged biasing member or an assembly error of the biasing member can be prevented, thereby improving safety.

As described above includes the support member with which the trigger is assembled. The contacting member is provided in the trigger to be operated by the biasing force of the biasing member to act on the support member, and the support member is detachable with respect to the tool body. With such a configuration, the support member with which the trigger is assembled can be attached in or detached from the tool body, which improves the assemblability.

As described above, in the tool body, the space is formed on the tip side of the pressed part pressed by the contacting member. When the movement of the contacting member is regulated by the movement regulating part, the contacting member can be inserted into the space. With such a configuration, when the contacting member is inserted into the space, the trigger can be assembled while the load of the biasing member is rarely received. Accordingly, it is possible to improve the assemblability of the trigger.

As described above, the tool body includes the opening through which the trigger can be inserted and extracted. In a state where the trigger is detached, the space is disposed to face outside through the opening. With such a configuration, when the trigger is attached toward the space, the trigger can be assembled by being inserted linearly from the opening. Accordingly, the assemblability of the trigger is improved.

BRIEF DESCRIPTION OF DRAWINGS

FIGS. 5A and 5B are perspective views illustrating an appearance of a trigger structure seen from the oblique rear side, wherein FIG. 5A is a view in the state of being assembled, and FIG. 5B is a view in the state where the trigger is detached;

DETAILED DESCRIPTION

First Embodiment

A first embodiment of the disclosure will be described with reference to FIGS. 1 to 7.

A hand tool 10 according to this embodiment is a driving tool, and is configured such that a fastener such as a screw or a nail is launched from an injection port 10*a*, and the fastener is driven to a driving target material. The hand tool 10 drives the fastener with a driver which is vertically driven by a predetermined power source. In this embodiment, a driving operation is performed by using compressed air supplied from outside. In addition, the power source of the hand tool 10 is not limited to the compressed air, and the hand tool 10 may be operated by using electricity, spring force, or the like, or may be operated by using combustion pressure of combustible gases. The hand tool 10 is not limited to the driving tool, and may be a tool including a trigger such as a circular saw, a drill driver, and a disc grinder.

Figure 1:
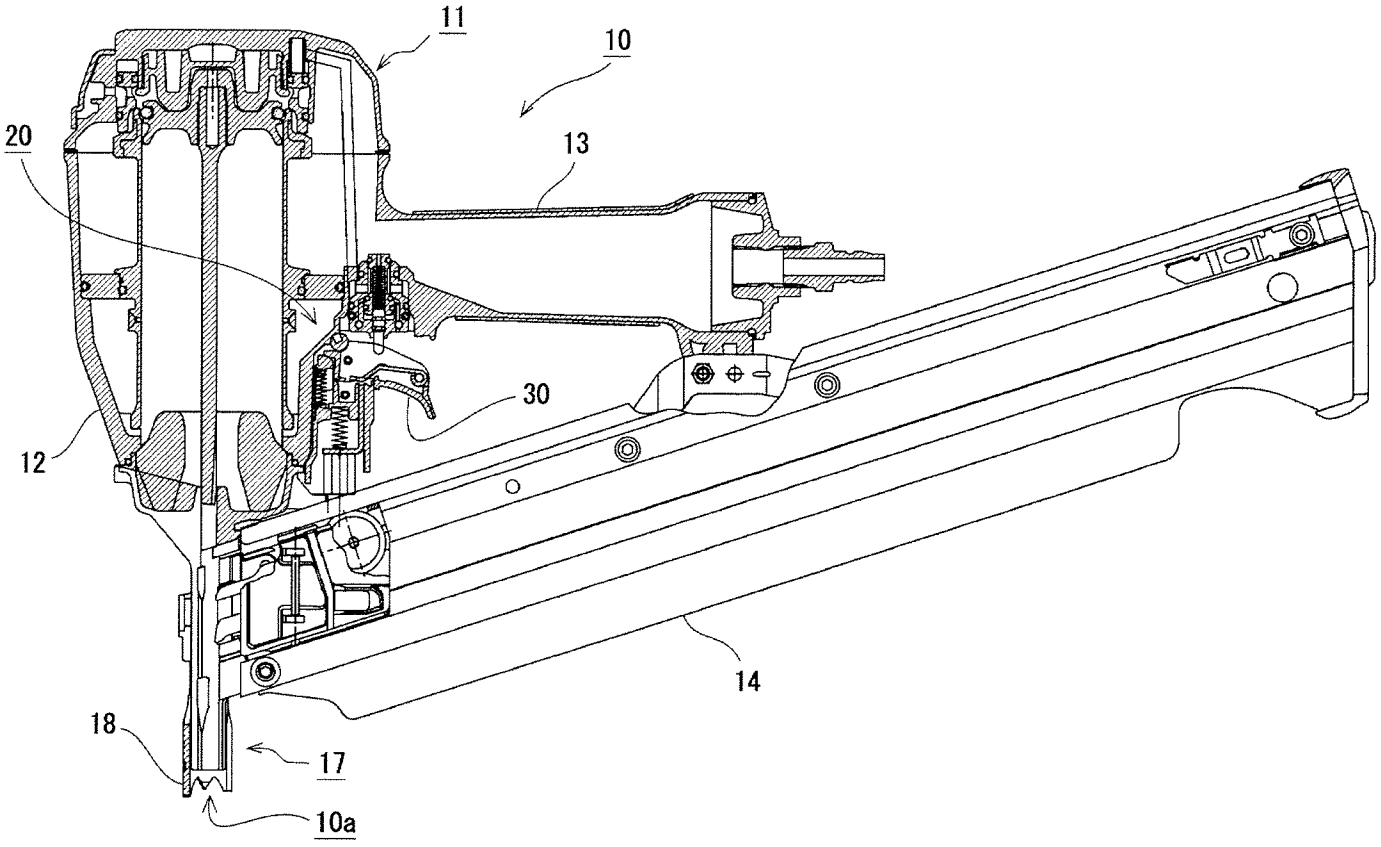
FIG. 1 is a cross-sectional side view illustrating a hand tool.

As illustrated in FIG. 1, a tool body 11 of the hand tool 10 includes an output part 12 in which an operating mechanism and the like for performing the driving operation is built, a grip part 13 which is connected with the output part 12 at substantially right angle, a nose part 17 which is fixed integrally with the tip side of the output part 12 in an axial direction (a driving direction of the fastener), and a magazine 14 which is connected with the rear side of the nose part 17. In addition, a trigger attaching part 20 for attaching a trigger 30 is provided in a boundary portion between the output part 12 and the grip part 13.

The trigger 30 is manually operated by an operator to operate the hand tool 10, and is an operation part for executing the driving operation in this embodiment. The trigger 30 is provided in a position where the operation can be performed with a forefinger when the grip part 13 is griped. When the trigger 30 is pulled in a state where a contact member 18 (to be described later) is pushed to the driving target material, the operating mechanism built in the output part 12 is operated to execute the driving operation.

Figure 2:
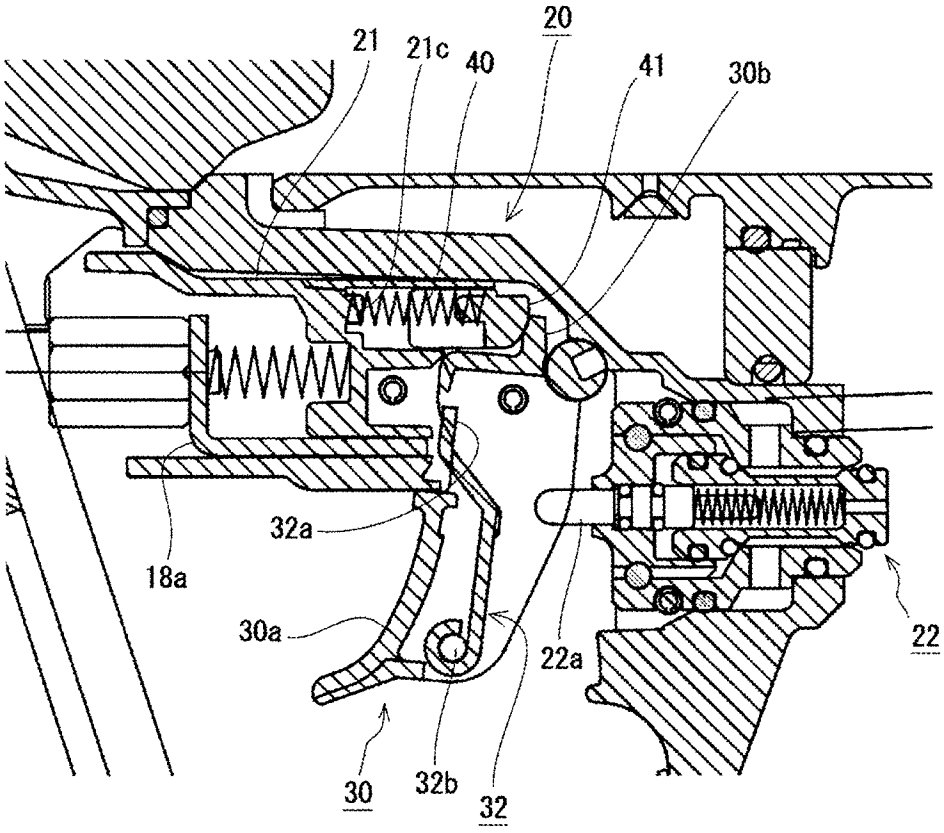
FIG. 2 is a partially enlarged sectional view illustrating a vicinity of a trigger in an initial state.
Figure 3:
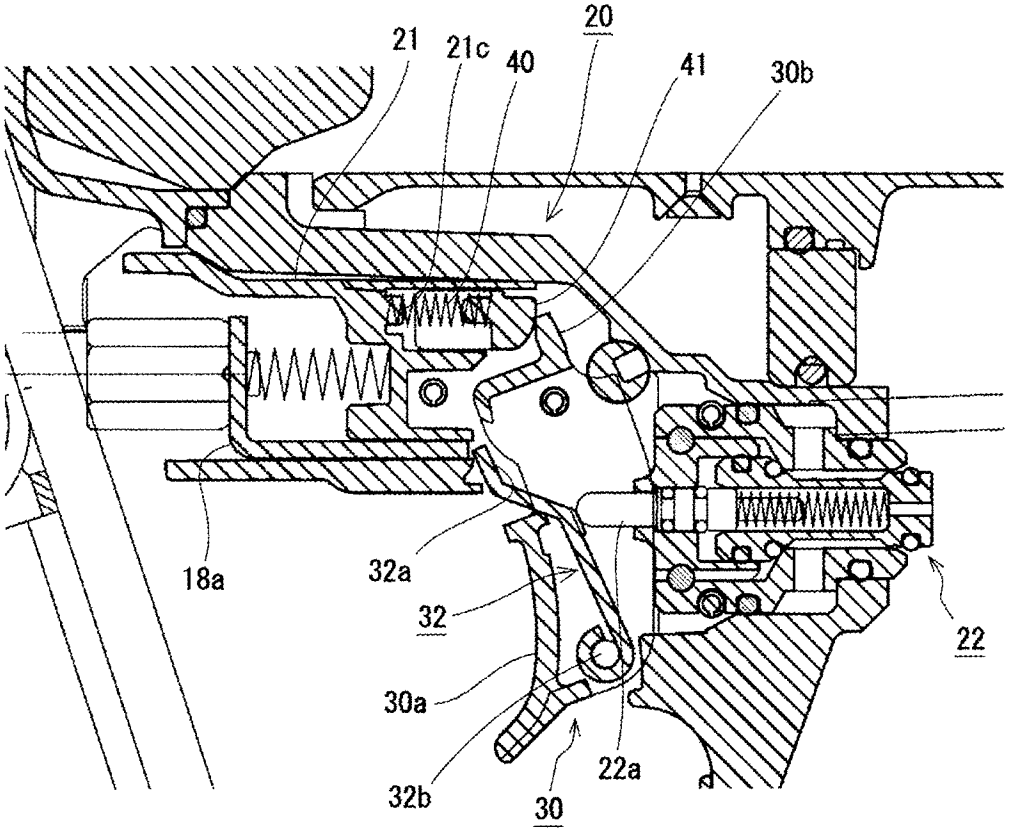
FIG. 3 is a partially enlarged sectional view illustrating the vicinity of the trigger in a state where the trigger is pulled.

As illustrated in FIGS. 2 and 3, the trigger 30 includes an operation part 30*a* on one end side and a pressed part 30*b* on the other end side. The operation part 30*a* is a part which is exposed from the tool body 11 to be operable, and is operated by the operator with a finger. In addition, the pressed part 30*b* is a part which is inserted into the tool body 11, and is swung in an opposite direction to the operation part 30*a* when the operation part 30*a* is operated to swing the trigger 30. The pressed part 30*b* is biased to the rear side by the contacting member 41 (to be described later), and thus the trigger 30 is usually biased in a direction of an initial position.

A contact lever 32 for operating a valve stem 22*a* of a trigger valve 22 is swingably attached in the trigger 30. The contact lever 32 is swingably supported by a spindle 32*b* formed in the operation part 30*a*. A tip 32*a* of the contact lever 32 which is not supported by the spindle 32*b* is disposed to face a contact interlocking member 18*a* (to be described later).

The magazine 14 is a part containing the fastener to be injected from the injection port 10*a*, and contains the connected fastener. The fastener contained in the magazine 14 is guided in order in a direction of the nose part 17 to be used for driving.

The nose part 17 is a part forming the injection port 10*a* through which the fastener is injected, and is formed to protrude to the tip of the tool body 11. The driver for driving out the fastener is slidably contained in the nose part 17. A fastener supply mechanism is provided on the rear side of the nose part 17. The fastener supply mechanism executes a feeding operation in conjunction with a driving operation. According to the feeding operation, the fastener contained in the magazine 14 is fed to the nose part 17 in order.

In the nose part 17, the contact member 18 is attached slidably. The contact member 18 is biased to protrude from the tip of the nose part 17, and can be pushed by a driving target material. When pushed to the driving target material, the contact member 18 slides to a direction opposite to the tip of the nose part 17. When the contact member 18 slides in the direction opposite to the tip of the nose part 17 as above, a safety mechanism of the driving operation is operated. When the safety mechanism is operated, the operation of the trigger 30 becomes effective, so that the fastener can be driven.

Figure 4:
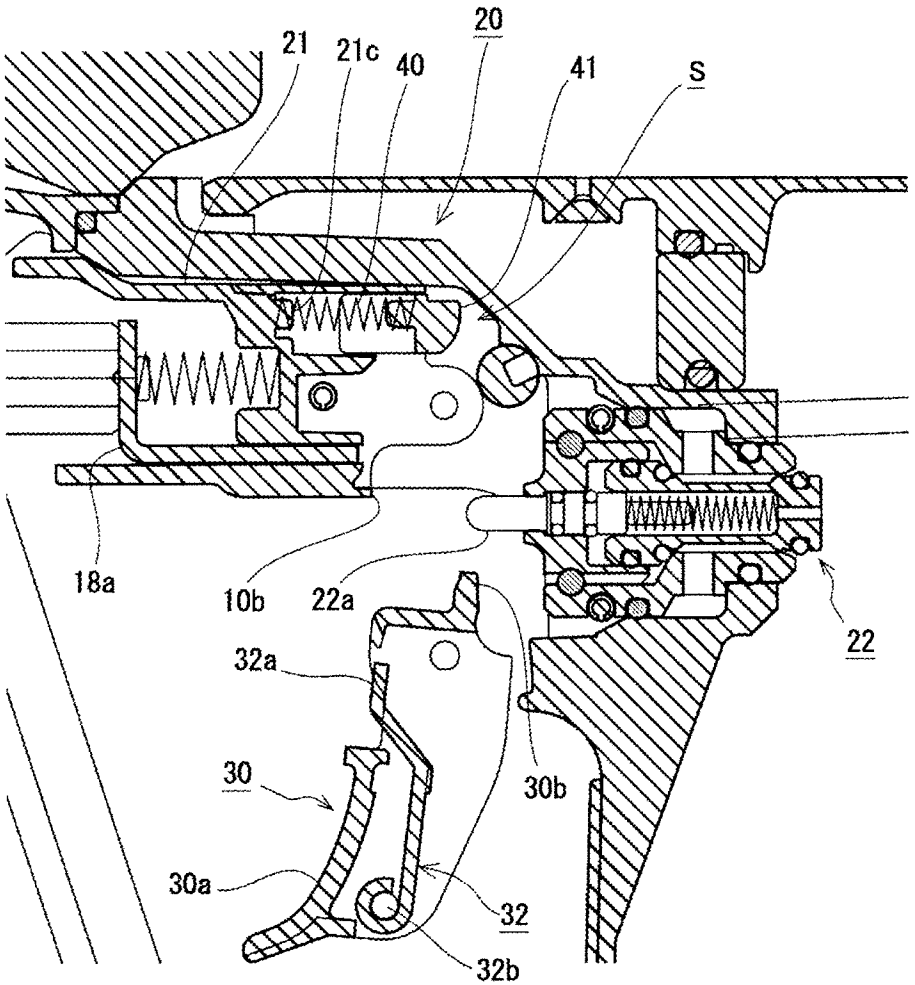
FIG. 4 is a partially enlarged sectional view illustrating the vicinity of the trigger in a state where the trigger is detached.

Specifically, when the contact member 18 is slid in the direction opposite to the tip of the nose part 17, the contact interlocking member 18*a* illustrated in FIGS. 2 to 4 moves to the rear side (right direction in FIGS. 2 to 4) in conjunction with the movement of the contact member 18. When the contact interlocking member 18*a* moves to the rear side, the tip 32*a* of the contact lever 32 is pushed in a direction of the trigger valve 22. When the trigger 30 is pulled in such a state, the valve stem 22*a* of the trigger valve 22 is pressed inside by the intermediate portion of the contact lever 32. When the valve stem 22*a* is pressed inside, the compressed air flows in a piston of the output part 12 at once to perform the driving operation.

Figure 5A:
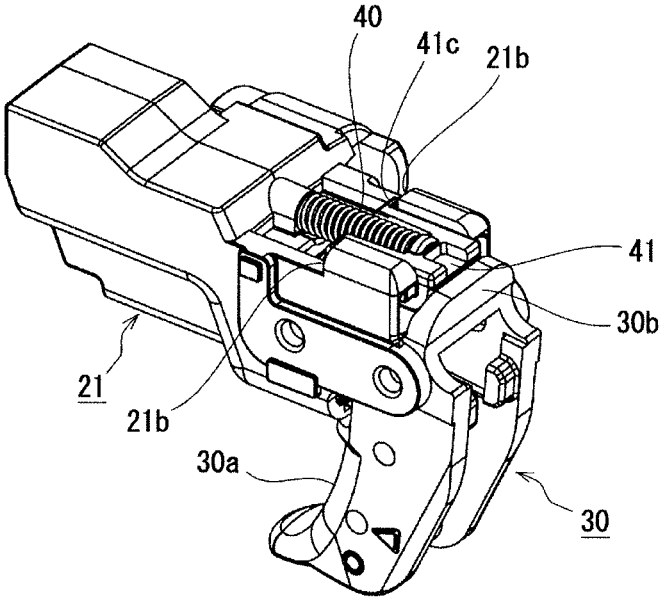
Figure 5B:
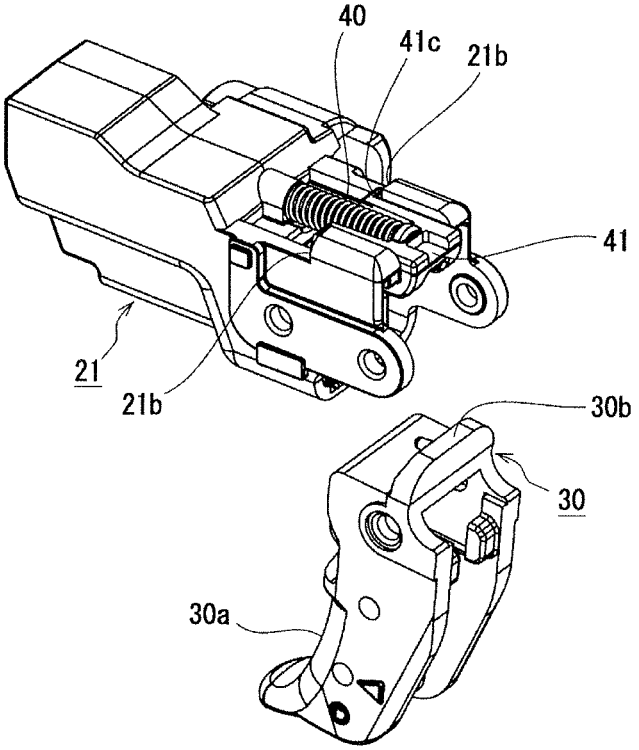

As illustrated in FIGS. 2 and 3, the above-described trigger 30 is supported to be swingable in the tool body 11. Specifically, as illustrated in FIG. 5A, a support member 21 is attached in the trigger attaching part 20 of the tool body 11, and the trigger 30 is swingably attached in the support member 21. The trigger 30 is attached by a fixing means (not illustrated) such as a pin or a bolt inserted from the side surface of the tool body 11. For this reason, as illustrated in FIGS. 4 and 5B, the trigger 30 can be detached from the tool body 11 by detaching the fixing means. In addition, in this embodiment, the support member 21 in which the trigger 30 is detachable is built in the tool body 11. However, the entire support member 21 is not necessarily covered with the tool body 11. The trigger 30 may be detachable with respect to the support member 21 in a state where the support member 21 is attached in the tool body 11.

As illustrated in FIG. 5B, the biasing member 40 and the contacting member 41 are assembled integrally with the support member 21. In other words, the biasing member 40 and the contacting member 41 are assembled integrally with the tool body 11 with which the support member 21 is assembled. For this reason, as illustrated in FIG. 4, even when the trigger 30 is detached from the tool body 11, the biasing member 40 and the contacting member 41 remain on the tool body 11.

The biasing member 40 generates a biasing force for biasing the trigger 30 in an opposite operation direction. The biasing member 40 according to this embodiment is a compressed spring which biases the contacting member 41 (to be described later). In addition, the biasing member 40 is not limited to the compressed spring, and may be any one which generates a predetermined biasing force. The biasing member may be, for example, a tension spring, another elastic body, a biasing member operated by air, or solenoid operated by electricity.

The contacting member 41 is operated by the biasing force of the biasing member 40 to act on the trigger 30, and is disposed between the biasing member 40 and the trigger 30. The contacting member 41 includes a spring attaching part 41*a* in which the biasing member 40 is attached, a sliding protrusion 41*b* formed to protrude to both sides, and an engagement part 41*c* which is engaged with a movement regulating part 21*b* (to be described later). The contacting member 41 is slidably attached in the support member 21 by engaging the sliding protrusion 41*b* in a sliding groove 21*a* (to be described later). In addition, the spring attaching part 41*a* is biased in a direction of being engaged in the trigger 30 by receiving the biasing force of the biasing member 40. The contacting member 41 biased by the biasing member 40 is slid to a position where the engagement part 41*c* abuts on the movement regulating part 21*b*. After the trigger 30 is pulled, the contacting member 41 presses the pressed part 30*b* of the trigger 30, so that the pulled trigger 30 returns to the initial position.

Figure 6:
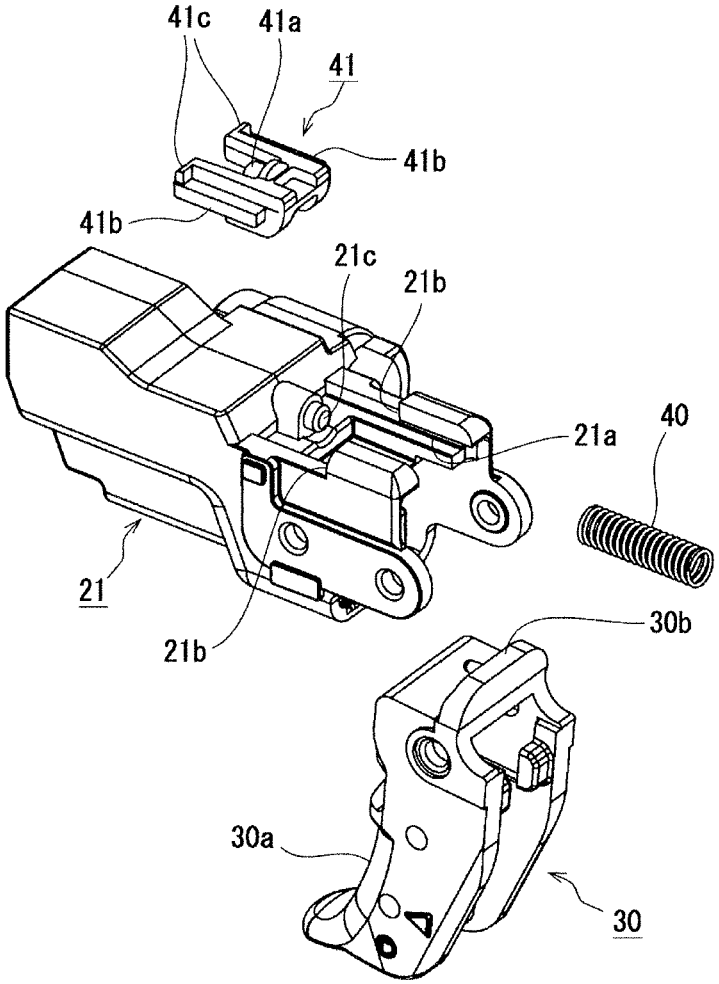
FIG. 6 is a perspective view illustrating the appearance of the trigger structure viewed from the oblique rear side in a state where a biasing member and a contacting member are disassembled.
Figure 7:
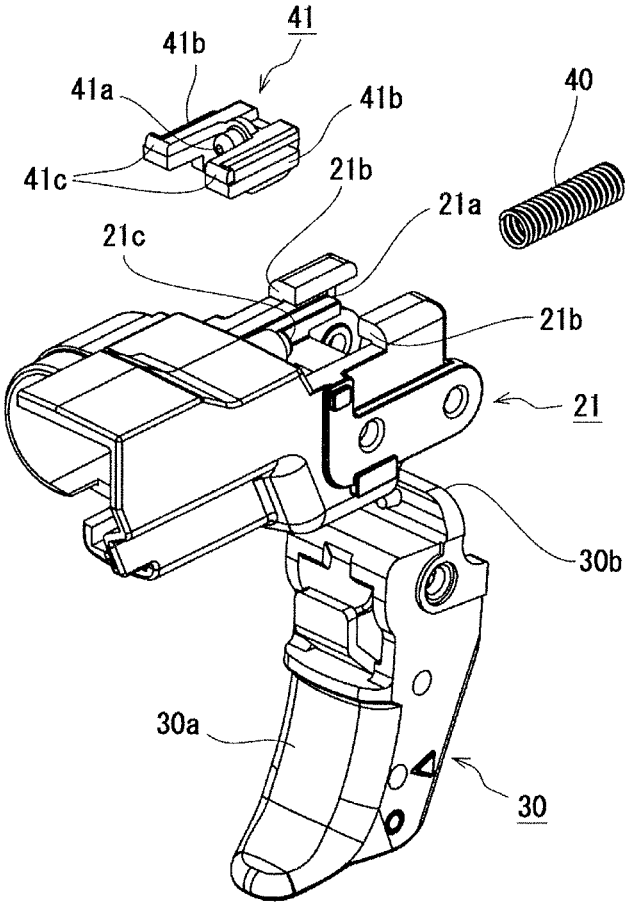
FIG. 7 is a perspective view illustrating the appearance of the trigger structure viewed from an oblique front side in the state where the biasing member and the contacting member are disassembled.

As illustrated in FIGS. 6 and 7, the support member 21 with which the biasing member 40 and the contacting member 41 are assembled includes the sliding groove 21*a* which guides the movement of the contacting member 41, the movement regulating part 21*b* which regulates the movement of the contacting member 41, and a spring receiving part 21*c* which receives the biasing force of the biasing member 40.

The sliding groove 21*a* is a groove into which the sliding protrusion 41*b* of the contacting member 41 is inserted, and guides the sliding of the contacting member 41. When the sliding protrusion 41*b* of the contacting member 41 is engaged with the sliding groove 21*a*, the contacting member 41 can be slid in a front and rear direction along a longitudinal direction of the sliding groove 21*a*.

The movement regulating part 21*b* is a wall portion which is engaged with the engagement part 41*c* of the contacting member 41. When the engagement part 41*c* of the contacting member 41 is engaged with the movement regulating part 21*b*, it is prevented that the contacting member 41 is fallen from the sliding groove 21*a*, and it is regulated that the contacting member 41 moves in the biasing direction of the biasing member 40. As illustrated in FIG. 4, when the movement of the contacting member 41 in a protruding direction is regulated as above, a space S is formed on the tip side of the contacting member 41 in the tool body 11. The space S is used to insert the pressed part 30*b* of the trigger 30. The width of the space S is formed to be the same as the width of the pressed part 30*b* of the trigger 30, or to be slightly larger than the width of the pressed part 30*b* of the trigger 30. For this reason, when the pressed part 30*b* of the trigger 30 is inserted into the space S, the biasing force of the biasing member 40 does not act on the pressed part 30*b*. In addition, the width of the space S may be formed to be slightly smaller than the width of the pressed part 30*b* of the trigger 30. With such a configuration, play of the trigger 30 may be prevented to improve the response of the trigger 30.

The spring receiving part 21*c* is a part for attaching the biasing member 40. The spring receiving part 21*c* is disposed to face the spring attaching part 41*a* of the contacting member 41. When the compressed biasing member 40 is attached between the spring receiving part 21*c* and the spring attaching part 41*a* of the contacting member 41, the support member 21 and the contacting member 41 are biased in a direction of being separated to each other.

As illustrated in FIG. 4, when the trigger 30 is detached from the support member 21 (that is, when the trigger 30 is detached from the tool body 11), an opening 10*b* through which the trigger 30 can be inserted and extracted is provided in the tool body 11. When the opening 10*b* is opened, the biasing member 40 receives the biasing force, and the movement of the contacting member 41 in a protruding direction is regulated. The tip of the contacting member 41 does not contact the inner wall of the tool body 11, and the space S is formed between the tip of the contacting member 41 and the inner wall of the tool body 11. The space S is disposed to face outside through the opening 10*b*. For this reason, if the trigger 30 is inserted linearly from the opening 10*b* at the time of attaching the detached trigger 30 again, the pressed part 30*b* is formed to protrude to the upper end of the trigger 30 inserted into the space S.

As described above, in this embodiment, since the biasing member 40 and the contacting member 41 are integrally assembled with the tool body 11, when the trigger 30 is detached from the tool body 11 for the maintenance and the like, the biasing member 40 such as a spring is not fallen. Accordingly, it is possible to prevent loss or damage of the biasing member 40. Also, the detached trigger 30 is easily assembled.

When the movement regulating part 21*b* regulates the movement of the contacting member 41, the space S is formed on the tip side of the contacting member 41. The trigger 30 includes the pressed part 30*b* inserted into the space S. With such a configuration, merely by inserting the pressed part 30*b* in the space S, the trigger 30 can be assembled while the load of the biasing member 40 is rarely received. Accordingly, it is possible to improve the assemblability of the trigger 30. In addition, the use of the damaged biasing member 40 or an assembly error of the biasing member 40 can be prevented to improve safety.

The tool body 11 includes the opening 10*b* through which the trigger 30 can be inserted and extracted, and the space S is disposed to face outside through the opening 10*b* in the state where the trigger 30 is detached. With such a configuration, when the trigger 30 is attached toward the space S, the trigger 30 can be assembled by being inserted linearly from the opening 10*b*. Accordingly, the assemblability of the trigger 30 is improved.

Second Embodiment

The second embodiment of the disclosure will be described with reference to FIGS. 8 to 10. This embodiment is characterized by that the biasing member 40 and the contacting member 41 are assembled integrally with the trigger 30 rather than that the biasing member 40 and the contacting member 41 are assembled integrally with the tool body 11. In addition, the basic configuration of this embodiment is not different from that of the first embodiment, and thus in order to avoid redundant description, only different parts will be described.

Figure 8:
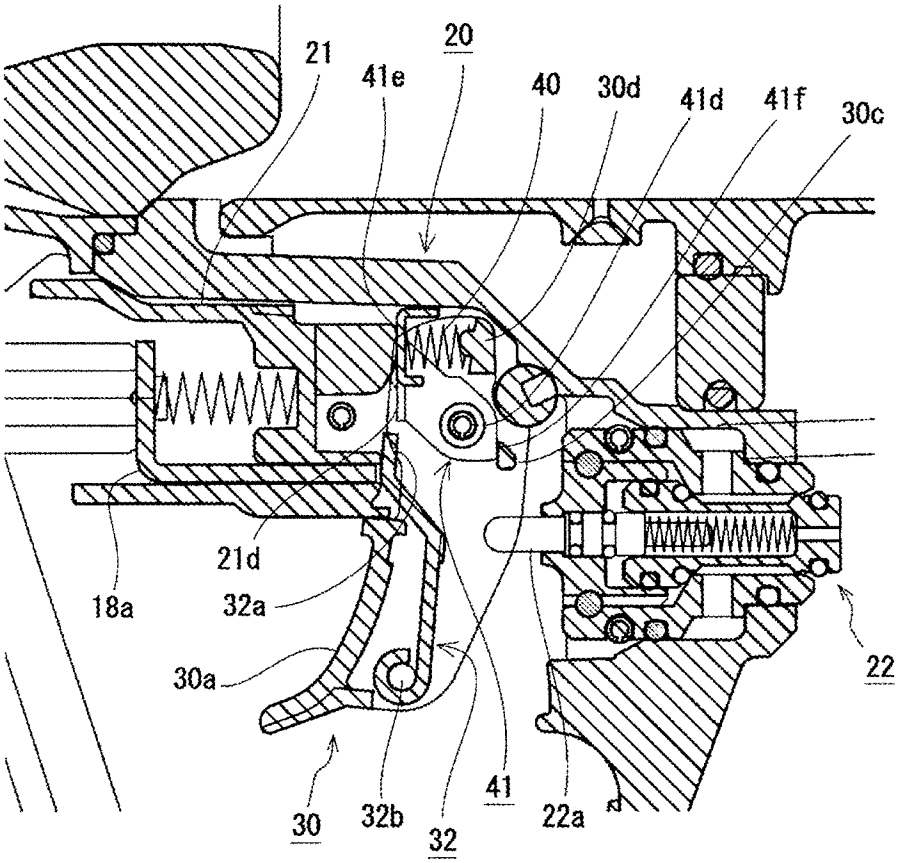
FIG. 8 is a partially enlarged sectional view illustrating a vicinity of a trigger according to a second embodiment in an initial state.
Figure 9:
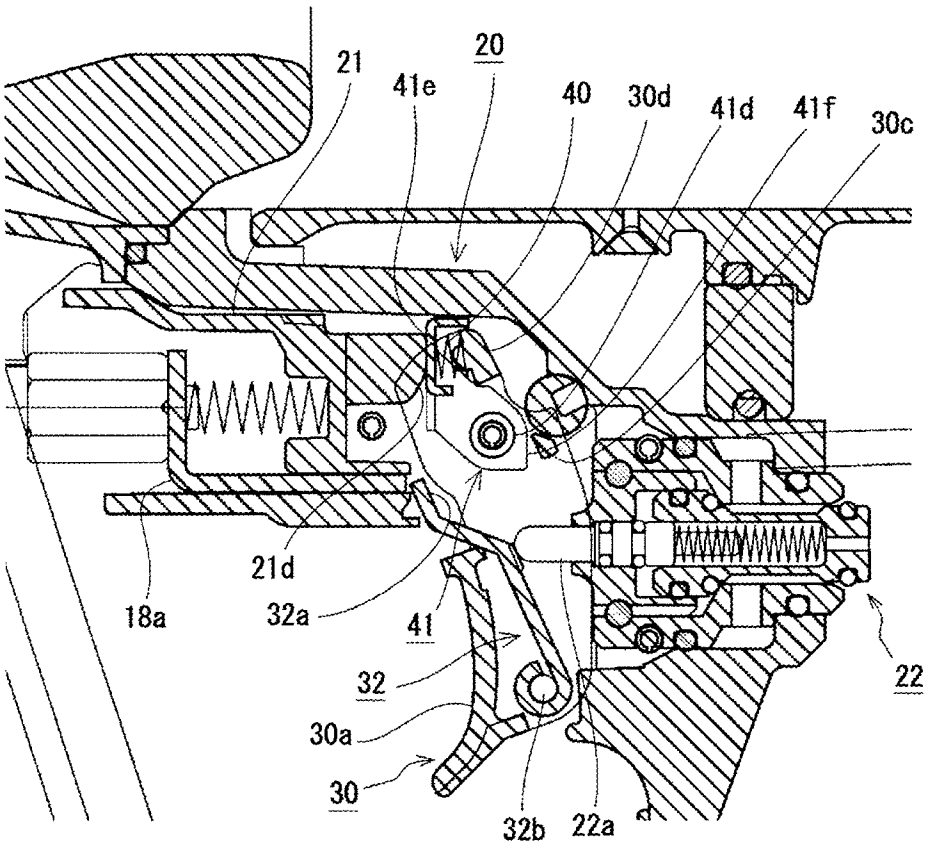
FIG. 9 is a partially enlarged sectional view illustrating the vicinity of the trigger according to the second embodiment in a state where the trigger is pulled.
Figure 10:
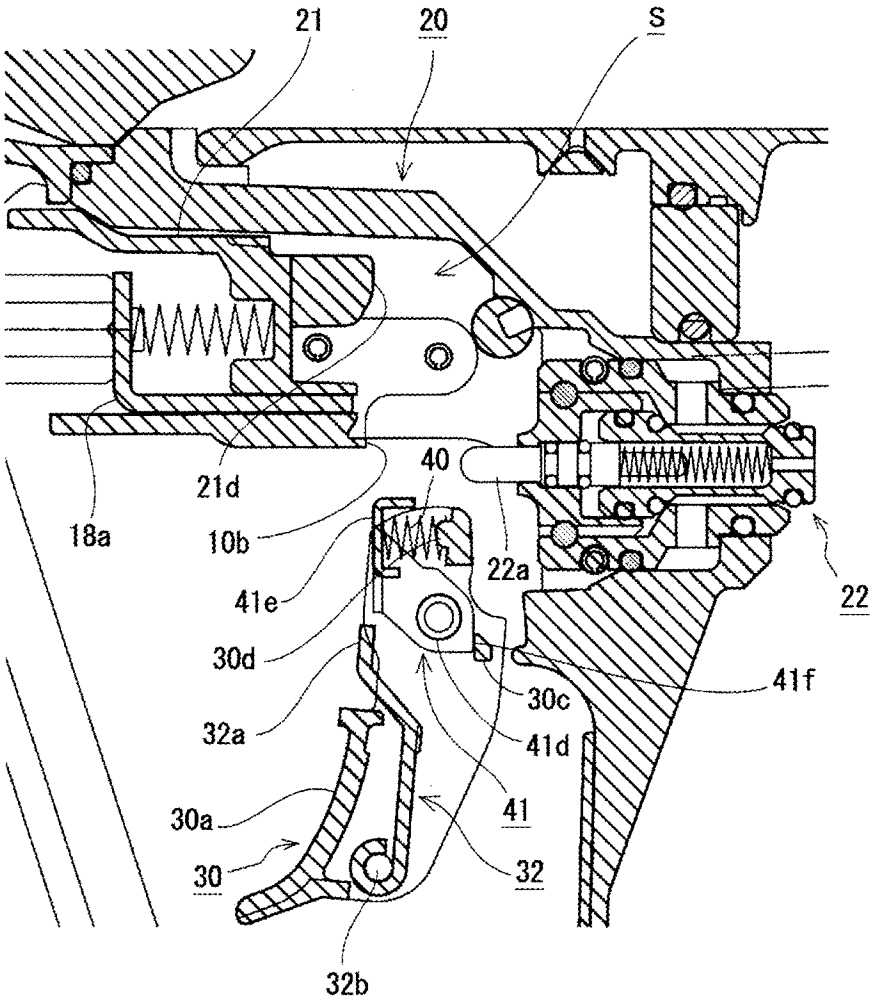
FIG. 10 is a partially enlarged sectional view illustrating the vicinity of the trigger according to the second embodiment in a state where the trigger is detached.

As illustrated in FIGS. 8 to 10, with the trigger 30 according to this embodiment, the biasing member 40 and the contacting member 41 are assembled integrally. For this reason, as illustrated in FIG. 10, when the trigger 30 is detached from the tool body 11, the biasing member 40 and the contacting member 41 are detached integrally with the trigger 30.

The biasing member 40 generates a biasing force for biasing the trigger 30 to the initial position. The biasing member 40 according to this embodiment is a compressed spring which biases the contacting member 41 (to be described later). In addition, the biasing member 40 is not limited to the compressed spring, and may be any one which generates a predetermined biasing force. The biasing member may be, for example, a tension spring, another elastic body, a biasing member operated by air, or solenoid operated by electricity.

The contacting member 41 is operated by the biasing force of the biasing member 40 to press the pressed part 21*d* of the tool body 11, and is swingably attached inside the trigger 30. The contacting member 41 includes a swing shaft part 41*d* for attaching swingably with respect to the trigger 30, a pressing part 41*e* disposed to face the pressed part 21*d* of the tool body 11, and an engaging part 41*f* engaging with a movement regulating part 30*c* (to be described later) of the trigger 30.

As illustrated in FIGS. 8 to 10, the trigger 30 with which the biasing member 40 and the contacting member 41 are assembled includes the movement regulating part 30*c* which regulates the movement of the contacting member 41, and a spring receiving part 30*d* which receives the biasing force of the biasing member 40.

The movement regulating part 30*c* is a protruding part engaged with the engaging part 41*f* of the contacting member 41. When the engaging part 41*f* of the contacting member 41 is engaged with the movement regulating part 30*c*, it is regulated that the contacting member 41 is swung by the biasing member 40 in a biasing direction. As illustrated in FIG. 10, when the swinging of the contacting member 41 is regulated as above, the contacting member 41 is regulated not to swing from the trigger 30 in a protruding direction. Since the contacting member 41 does not protrude from the trigger 30, the contacting member 41 is easily inserted into the space S (to be described later).

The spring receiving part 30*d* is a part for attaching one end of the biasing member 40. The spring receiving part 30*d* is disposed to face the back side of the pressing part 41*e* of the contacting member 41. Since the other end of the biasing member 40 is attached on the back side of the pressing part 41*e* of the contacting member 41, the spring receiving part 30*d* and the pressing part 41*e* are biased by the biasing member 40 in a direction of being separated to each other.

As illustrated in FIG. 9, when the trigger 30 is pulled, the trigger 30 is swung with respect to the contacting member 41 so that the biasing member 40 is compressed. Thereafter, when the trigger 30 is released, by the restoring force of the biasing member 40, the pressing part 41*e* of the contacting member 41 presses the pressed part 21*d* of the tool body 11, and by the counterforce thereof, the pulled trigger 30 returns to the initial position.

As illustrated in FIGS. 8 to 10, the support member 21 according to this embodiment is attached in the tool body 11, and includes the pressed part 21*d* pressed by the contacting member 41. As illustrated in FIG. 10, the space S for inserting the upper end of the trigger 30 and the contacting member 41 is formed on the tip side of the pressed part 21*d*. In addition, in this embodiment, the support member 21 in which the trigger 30 is detachable is built in the tool body 11. However, the entire support member 21 is not necessarily covered with the tool body 11. In a state where the support member 21 is attached in the tool body 11, the trigger 30 may be detachable with respect to the support member 21.

The width of the space S is formed to be the same as the width of the upper end of the trigger 30 inserted into the space S and the contacting member 41, or to be slightly larger than the width of the upper end of the trigger 30 and the contacting member 41 which are inserted in the space S. For this reason, when the trigger 30 is inserted into the space S, the biasing force of the biasing member 40 does not act thereon. In addition, the width of the space S may be formed to be slightly smaller than the width of the upper end of the trigger 30 and the contacting member 41 which are inserted into the space S. With such a configuration, play of the trigger 30 can be prevented to improve the response of the trigger 30.

When the trigger 30 is detached from the support member 21 (that is, when the trigger 30 is detached from the tool body 11), as illustrated in FIG. 10, the opening 10*b* through which the trigger 30 can be inserted and extracted is provided in the tool body 11. In addition, the above-described space S is disposed to face outside through the opening 10*b*. For this reason, if the trigger 30 is inserted linearly from the opening 10*b* at the time of attaching the detached trigger 30 again, the upper end of the trigger 30 and the contacting member 41 are inserted into the space S.

As described above, in this embodiment, since the biasing member 40 and the contacting member 41 are integrally assembled with the trigger 30, the biasing member 40 such as a spring is not fallen when the trigger 30 is detached from the tool body 11 for the maintenance and the like. Accordingly, it is possible to prevent loss or damage of the biasing member 40. In addition, the detached trigger 30 is easily assembled. In addition, the use of the damaged biasing member 40 or an assembly error of the biasing member 40 can be prevented to improve safety.

In the tool body 11, the space S is formed on the tip side of the pressed part 21*d* pressed by the contacting member 41, and the movement of the contacting member 41 is regulated by the movement regulating part 30*c* so that the contacting member 41 can be inserted into the space S. With such a configuration, when the contacting member 41 is inserted into the space S, the trigger 30 can be assembled while the load of the biasing member 40 is rarely received. Accordingly, it is possible to improve the assemblability of the trigger 30.

The tool body 11 includes the opening 10*b* through which the trigger 30 can be inserted and extracted, and the space S is disposed to face outside through the opening 10*b* in a state where the trigger 30 is detached. With such a configuration, when the trigger 30 is attached toward the space S, the trigger 30 can be assembled by being inserted linearly from the opening 10*b*. Accordingly, the assemblability of the trigger 30 is improved.

In the above-described second embodiment, the trigger 30 is detachable with respect to the support member 21. However, the support member 21 assembled with the trigger 30 may be detachable with respect to the tool body 11. That is, a unit obtained by assembling the trigger 30, the biasing member 40, and the contacting member 41 with the support member 21 in advance may be detachable with respect to the tool body 11. Also in the case of such a configuration, the biasing member 40 and the contacting member 41 are assembled integrally with the trigger 30, and thus the biasing member 40 and the contacting member 41 can be detached together with the trigger 30, so that the same effect as in the above-described second embodiment can be obtained.

In the above-described first embodiment and second embodiment, the swinging trigger 30 has been described. However, the same effect can be also obtained in the linearly-sliding trigger 30.

The invention claimed is:

1. A hand tool comprising:

a trigger manually operated by an operator;

a support member configured to movably support the trigger;

a biasing member which is provided on the support member and which is configured to generate a biasing force for biasing the trigger in a biasing direction, wherein the biasing direction is a direction opposite to an operation direction of the trigger;

a contacting member which is slidably provided on the support member and which is operated by the biasing force of the biasing member to bias the trigger in the biasing direction, wherein the biasing member and the contacting member are assembled integrally with the support member, wherein the trigger is detachable with respect to the support member in a state where the biasing member, the contacting member and the support member are assembled integrally with a tool body, wherein the support member comprises a movement regulating part configured to regulate a movement of the contacting member by the biasing member in the biasing direction, wherein a space is formed on a tip side of the contacting member as the contacting member engages with the movement regulating part by the biasing force of the biasing member in a state where the trigger is detached from the support member and the movement regulating part regulates the movement of the contacting member, and wherein the trigger comprises a pressed part which is inserted into the space to be pressed by the contacting member.

2. The hand tool according to claim 1, wherein the support member is assembled with the trigger, the biasing member, and the contacting member, and wherein the support member is detachable with respect to the tool body.

3. The hand tool according to claim 1, wherein the tool body comprises an opening through which the trigger is capable of being inserted and extracted, and wherein the space is disposed to face outside through the opening in a state where the trigger is detached.

4. A hand tool comprising:

a trigger manually operated by an operator;

a support member configured to movably support the trigger;

a biasing member which is provided on the trigger and which is configured to generate a biasing force for biasing the trigger in a biasing direction, wherein the biasing direction is a direction opposite to an operation direction of the trigger;

a contacting member operated by the biasing force of the biasing member to act on the support member, wherein the support member is assembled with a tool body, wherein the biasing member and the contacting member are assembled integrally with the trigger and operate with the biasing force of the biasing member acting on the support member, wherein the trigger along with the integrally assembled biasing member and contacting member is detachable with respect to the support member, wherein the support member comprises a space which is formed at a tip side of a pressed part of the support member which is pressed by the contacting member, wherein the trigger comprises a movement regulating part configured to regulate a movement of the contacting member by the biasing member in the biasing direction, and wherein a width of a tip of the trigger is regulated as the movement of the contacting member is regulated by the movement regulating part such that when the trigger along with the integrally assembled biasing member and contacting member is detached with respect to the support member, the tip of the trigger having the width of the tip regulated by the movement regulating part is insertable into the space.

5. The hand tool according to claim 4, wherein the tool body comprises an opening through which the trigger is capable of being inserted and extracted, and wherein the space is disposed to face outside through the opening in a state where the trigger is detached.

* * * * *